US006196112B1

(12) United States Patent
Büter

(10) Patent No.: US 6,196,112 B1
(45) Date of Patent: Mar. 6, 2001

(54) SCREW-ON PRESSURE MEDIUM-ACTUATED WORKING CYLINDER WITH CLOSURE COMPONENTS FOR COUPLING THE CYLINDER TUBE

(75) Inventor: Josef Büter, Haren (DE)

(73) Assignee: Buemach Engineering International B.V., Emmen (NL)

( * ) Notice: Subject to any disclaimer, the term of this patent is extended or adjusted under 35 U.S.C. 154(b) by 0 days.

(21) Appl. No.: 09/101,650

(22) PCT Filed: Jan. 4, 1997

(86) PCT No.: PCT/DE97/00039

§ 371 Date: Jul. 14, 1998

§ 102(e) Date: Jul. 14, 1998

(87) PCT Pub. No.: WO97/29287

PCT Pub. Date: Aug. 14, 1997

(30) Foreign Application Priority Data

Feb. 7, 1996 (DE) ..... 296 02 088 U

(51) Int. Cl.[7] ..... F01B 31/28
(52) U.S. Cl. ..... 92/169.1
(58) Field of Search ..... 92/169.1, 171.1; 72/103, 104, 110, 118; 29/888.06

(56) References Cited

U.S. PATENT DOCUMENTS

| | | | | |
|---|---|---|---|---|
| 2,345,871 | * | 4/1944 | Hallberg | 72/118 |
| 2,981,575 | * | 4/1961 | Leman | 92/171.1 |
| 3,867,824 | * | 2/1975 | Takagi et al. | 72/118 |
| 5,372,529 | * | 12/1994 | Binversie et al. | 92/169.1 |
| 5,415,079 | * | 5/1995 | Ching | 92/171.1 |

FOREIGN PATENT DOCUMENTS

| | | | | |
|---|---|---|---|---|
| OS 19 215 43 | | 5/1965 | (DE) . | |
| 35 17 137 A1 | | 11/1986 | (DE) . | |
| 0 601 736 A1 | | 6/1994 | (EP) . | |
| 35861 | * | 4/1981 | (JP) | 92/169.1 |

OTHER PUBLICATIONS

Beer et al, Mechanics of Materials, McGraw–Hill, 1981, front cover, p. 585.*

* cited by examiner

*Primary Examiner*—F. Daniel Lopez
(74) *Attorney, Agent, or Firm*—Michael J. Striker

(57) ABSTRACT

The fluid pressure actuator includes a cylinder tube for at least one piston and a closure element provided on a first end of the cylinder tube. Respective sealing chamfers are provided on the closure element and on the first end of the cylinder tube or on a manufactured insert between the closure element and the first end of the cylinder tube. Each sealing chamfer has a slope between 6 degrees and 12 degrees. Respective screw threads are provided on the closure element and the first end of the cylinder tube, near the corresponding sealing chamfers. Portions of the closure element or the manufactured insert and the first end of the cylinder tube including the sealing chamfers are made of a material having a modulus of elasticity in a range between 60*103 N/mm$^2$ and 250*103 N/mm2 plus or minus 10%, and an elastic limit in a range between 200 and 1050 N/mm$^2$, over a temperature range of 0° C. to 200° C., so that, when the closure element is screwed on the first end of the cylinder tube by respective screw threads, the sealing chamfers are pressed on each other and thus interact to prevent leakage of fluid between the closure element and the first end of the cylinder tube. The sealing chamfers and the screws threads are preferably formed in non-cutting or non-milling operations and the sealing chamfers have a surface roughness that does not exceed 0.4 microns.

9 Claims, 3 Drawing Sheets

4
6
17,19
9
15,20
12
10
2
16,19
18

SCREW-ON PRESSURE MEDIUM-ACTUATED WORKING CYLINDER WITH CLOSURE COMPONENTS FOR COUPLING THE CYLINDER TUBE

BACKGROUND OF THE INVENTION

1. Field of the Invention

This invention relates to a screwable pressure actuated operating cylinder with closure elements for closing the cylinder tube, which can be employed to produce translational movement of mechanisms in the field of fluidic energy transmission utilizing flowing media (liquids, gases) as pressure media, where this operating cylinder is particular suitable for high pressure aggressive media.

2. Prior Art

Screwable pressure medium actuated operating cylinders in accordance with German patent DE OS 19 215 43 are known, in particular hydraulic differential or plunger pistons, whose cylinder tube, capable of accepting one piston, is provided with closure elements provided at the lower or head end. These closure elements are screwed up over the outer thread of the cylinder tube, and closed securely against leaks via a ring seal located on the inner thread.

Furthermore, screwable operating cylinders are known in accordance with patent EP 060 17 36 A 1, where the thread carrying the closure elements is arranged in the inner shell of the cylinder tube and where sealing is achieved via sealing elements. At the same time, screwable operating cylinders having cylinder tube inner-, or cylinder tube-outer threads are known, in which sealing is achieved by means of an elastomer seal, which is located in the ring face of the cylinder tube or, also, as described in German patent DE 35 17 137 A 1, as a face seal of the guide closure element.

All known screwable operating cylinders always achieve cylinder tube sealing by the insertion of elastomer sealing elements.

In these embodiments the frequency of faults developing in the high pressure range as well as the complicated and therefore expensive metal-cutting required in manufacture.

Pressure medium-actuated linear motors in threaded embodiments necessitate highly developed manufacturing technology and are therefore expensive to manufacture. Nevertheless, they can only be used to a limited extent, especially in the aggressive high pressure range. If the components of the operating cylinder are coated, in order to make them resistant against aggressive media, additional costs arise for the manufacture of the joining elements, which also remain prone to frequent faults due to the effect of high pressure substances.

Known technical solutions require highly skilled personnel for manufacture of the individual components of the operating cylinder, so that the manufacturing costs for known technical solutions are high.

SUMMARY OF THE INVENTION

The proposed solution is distinguished from the above-described prior art operating cylinder, in that it does not exhibit the aforesaid disadvantages.

It is the object of the invention to develop a screwable pressure-medium actuated operating cylinder, which operates with reliable sealing performance in the high pressure range, even with aggressive media, which can be produced economically and which, using mainly non-machining manufacturing technology, is simple to manufacture, and has advantages resulting therefrom.

These objects are attained according to the invention by a fluid pressure actuator comprising a cylinder tube capable of accepting at least one piston and a closure element provided on a first end of the cylinder tube. Respective sealing chamfers are provided on the closure element and on the first end of the cylinder tube, which each have a slope between 6 degrees and 12 degrees. Respective screw threads are provided on the closure element and the first end of the cylinder tube, near the corresponding sealing chamfers. Portions of the closure element and the first end of the cylinder tube including the sealing chamfers are made of a material having a modulus of elasticity in a range between $60*10^3$ N/mm$^2$ and $250*10^3$ N/mm$^2$ plus or minus 10%, and an elastic limit in a range between 200 and 1050 N/mm$^2$, over a temperature range of 0° C. and 200° C., so that, when the closure element is fixed to the first end of the cylinder tube by respective screw threads on the closure element and the first end of the cylinder tube, the sealing chamfers of the closure element and the first end of the cylinder tube are pressed on each other and thus interact to prevent leakage of fluid between the closure element and the first end of the cylinder tube.

Advantageous additional features are claimed in the appended dependent claims.

In particularly preferred embodiments the sealing chamfers and the screws threads are preferably both formed by a non-cutting operation and the sealing chamfers have a surface roughness that does not exceed 0.4 microns.

The advantages of the invention include the following: the operating cylinder functions in a trouble-free manner in the high pressure region, its manufacture is simpler and expensive machining is not required.

Furthermore, the operating cylinder is capable of operation in aggressive media, where the need of coating the operating cylinder does not arise, due to the resistance achievable, in the case of suitable material selection. As a result of forming the operating cylinder as a screw-press connecting component, expensive welding connections are avoided, and replacement of worn individual components can be carried out without difficulties. Higher surface pressure on the sealing surfaces is achieved as a result of the non-machining manufacture of the sealing surfaces. Manufacture and assembly of the components is simple, and can be carried out by inexperienced personnel, who are not specifically trained.

BRIEF DESCRIPTION OF THE DRAWING

The objects, features and advantages of the invention will now be illustrated in more detail with the aid of the following description of the preferred embodiments, with reference to the accompanying figures, in which in FIG. 1 as a cross-section through the screwable pressure-medium actuated operating cylinder in FIG. 2 as a detailed view of sealing area "X"

DESCRIPTION OF THE PREFERRED EMBODIMENTS

Figure 1:
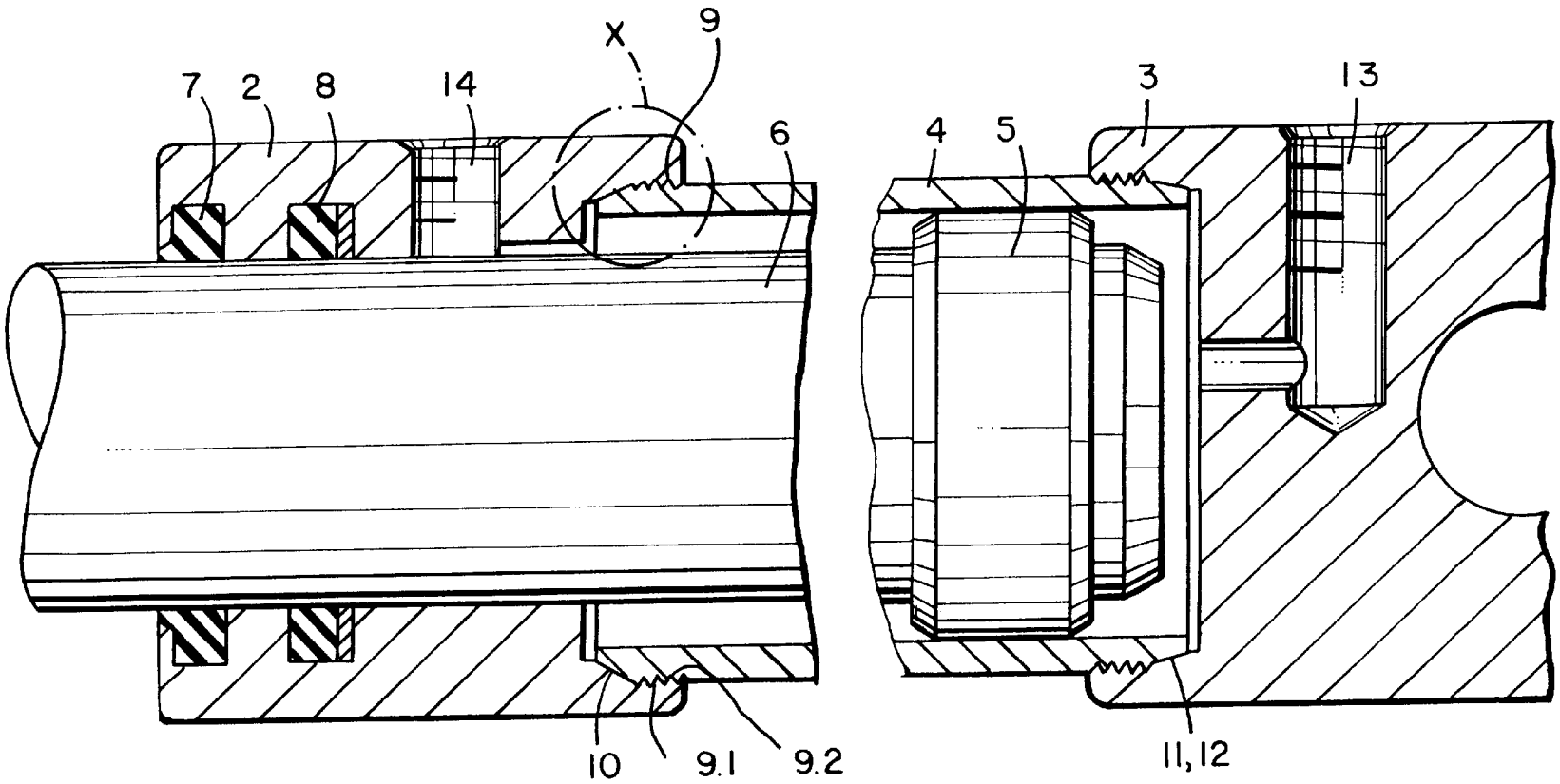

FIG. 1 shows a screwable pressure medium actuated operating cylinder 1 comprising a guidance closure element 2, a bottom closure element 3, a cylinder tube 4 and a differential piston 5 having a piston rod 6.

For the purpose of sealing piston rod 6. The cylinder tube 4 is provided with outer or exterior threads and sealing surface on the opposing or facing surfaces of the outer tube casing. A wiper seal 7 and a guide seal 8 are provided. The sealing of a thread pair 9 is achieved by strong axial metallic pressure of a guide closure element sealing surface 10 or a bottom closure element sealing surface 11 with the respective chamfered cylinder tube sealing surface 12, as a result of screwing of the guidance closure element 2 and the bottom closure element 3 to the cylinder tube 4. The thread pair 9 consists of external thread 9.1 of cylinder tube 4 and the internal thread 9.2 of guidance closure element 2.

Commissioning of the screwable pressure medium-actuated operating cylinder 1 is achieved in a known manner via operating cylinder pressure connection 13 and operating cylinder exhaust connection 14.

Figure 2:
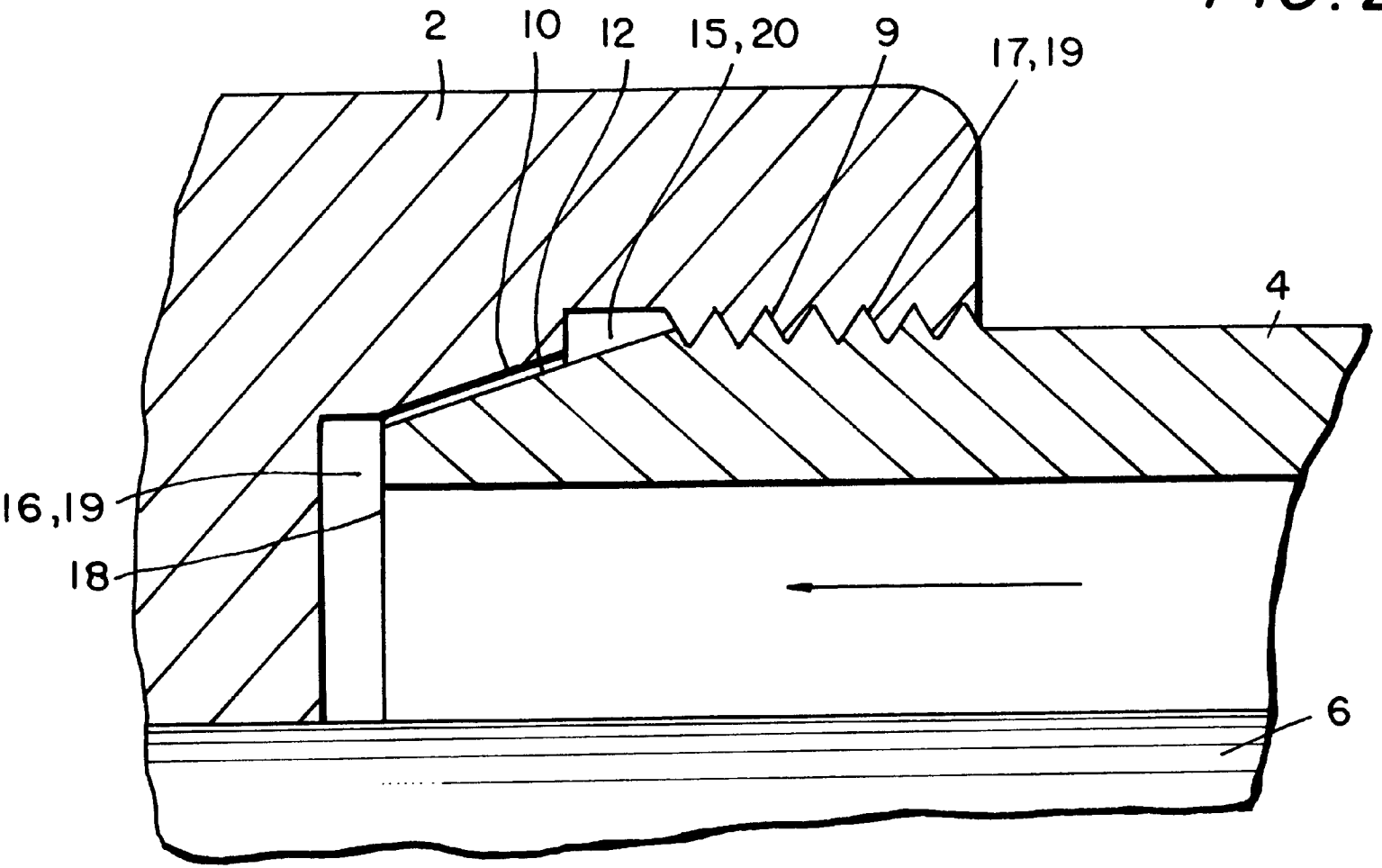

FIG. 2 shows in more detail the portion of sealing region "X" of FIG. 1, where the guidance closure element 2 is associated with free space 15, a hollow space 16, guidance sealing surface 10 and thread clearance spaces 17 and where cylinder tube 4 consists of cylinder tube sealing surface 12 and of face ring surface 18, where guidance closure element 2 is in operative connection with cylinder tube via guidance closure element sealing surface 10 and via thread pair 9. Piston rod 6 is shown assembled as a function element in this system.

In order to achieve adequate sealing under operating conditions, pressure is maintained high enough, so that the guidance closure element sealing surface 10, bottom closure element sealing surface 11 (not shown—see FIG. 1) and the cylinder tube sealing surfaces 12 are able to follow the axial and also the radial displacements in the lattice structure of the materials, without the bottom closure sealing surface 11 lifting off from cylinder tube sealing surface 12.

In order to achieve the required force on the components to be screwed together, free space 15 is provided. Here the face ring surface 18 of cylinder tube 4 projects into empty space 16, which space is at the same time suitable for accepting a low viscosity adhesive 19. At the same time, the thread clearance spaces 17 of thread pair 9 can be filled with this low viscosity adhesive 19.

Thread pair 9, guidance closure element sealing surface 10, bottom closure element sealing surface 11 (not shown—see FIG. 1) as well as cylinder sealing surfaces 12 are produced by non-cutting forming, which allows high area pressures to be achieved on the bottom closure element sealing surface 11 and the cylinder tube sealing surface 12.

Figure 3:
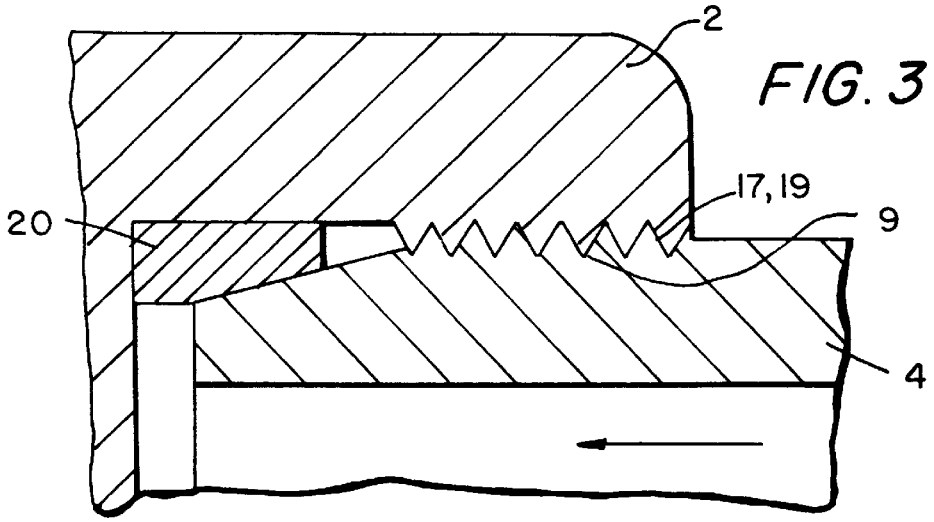
FIG. 3 is a cross-section through a cylinder tube with an external thread and a sealing face located on the face of the outer casing.

FIG. 3 shows cylinder tube 4 in operative connection with guidance closure element 2 via a replaceable insert 20 and thread pair 9. The low viscosity adhesive 10 can be inserted into thread clearance spaces 17.

Figure 4:
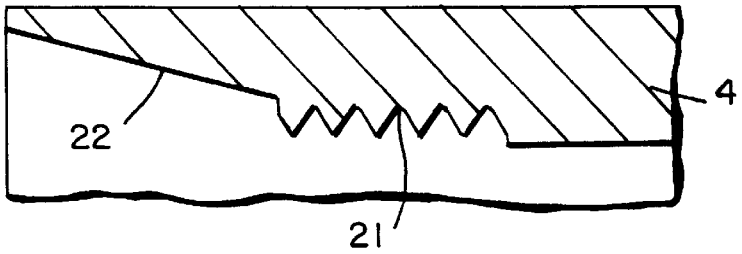
FIG. 4 is a cross-section through a cylinder tube with an internal thread and a sealing face with insert located on the face of the inner casing.

In accordance with FIG. 4, cylinder tube 4 is shown with an internally located thread 21 and an internal tube sealing surface 22.

Figure 5:
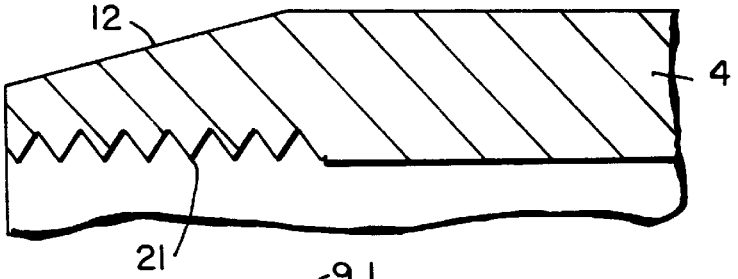
FIG. 5 is a cross-section through a cylinder tube with inner thread and a sealing face located on the face of the outer tube casing.

In accordance with FIG. 5, cylinder tube 4 is shown with an internally located thread 21 and cylinder tube sealing surface 12.

Figure 6:
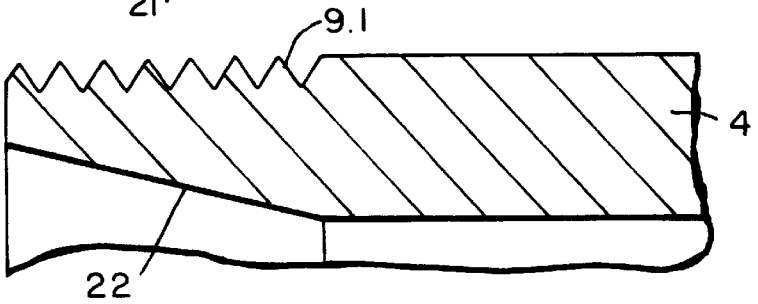
FIG. 6 is a cross-section through a cylinder tube with an external thread and a sealing face located on the face of the inner tube casing.

In accordance with FIG. 6, cylinder tube 4 is shown with external thread 9.1 with internal casing sealing surface 22.

Figure 7:
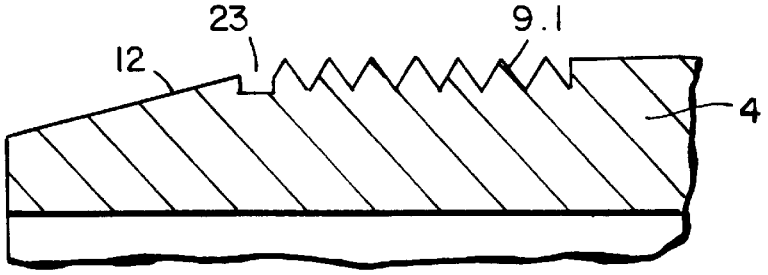
FIG. 7 is a cross-section through a cylinder tube with an external thread and a sealing face located on the face of the outer casing.

In accordance with FIG. 7, cylinder tube 4 is shown with external thread 9.1 and cylinder tube sealing surface 12, in that external thread 9.1 is provided with a relief groove 23.

According to the essential inventive concept the guidance closure element 2 and the bottom closure element 3 of the operating cylinder 1 are screwed together with the cylinder tube 4, which is provided with the sealing chamfers at its ends, which are pressed against the guidance closure element sealing surface 10 and the bottom closure element surface 11 on the guidance closure element 2 and the bottom closure element 3 respectively, whereby the axial concentric pressing forces on the components being screwed together are large enough, so that a relief or unloading occurs in the operating state, because of the action of the internal pressure in the operating cylinder 1, which further guarantees operation in the elastic range for the materials pressed together.

In order to be able to provide a residual pressing force which ensures sealing of the closure, this elastic region must not be deviated from.

The components subject to the pressure are made of a steel alloy, whose metallic composition has to suit the requirements of the particular applications.

Fundamentally, four embodiments of the invention, as shown in FIGS. 4 to 7, are possible.

Each of these embodiments makes it possible to form the conformal guidance closure element sealing surface 10 in guidance closure element 2 and bottom closure element 3 as a replaceable insert 20, so that the variety of possible implementations is increased by this number of possibilities. The implementation embodiments always have specific advantages, according to the particular applications.

This sort of operating cylinder with screw and press-fit connecting components makes expensive welded connections necessary and also permits simple employment of other pressure mediums, in association with suitable materials of the elements.

Application of non-cutting metal forming of the major parts of the pressure elements also prevents undesired notch stress concentrations.

In this connection the changes of mechanical characteristics of the materials of the elements have advantages, because the crystalline changes in the materials, caused by cold forming, result in an increase of stiffness and in reduced expansion.

This effect caused by the manufacturing process for the operating cylinder 1 according to the invention assists in material reduction. Increase of stiffness in the vicinity of the guidance closure element sealing surface 10, bottom closure element sealing surface 11, cylinder tube sealing surface 12 and inner tube sealing surface 22 allows increases of pressure per area, as a result of which the sealing areas in the radial expansions of these sealing surfaces can be reduced.

The dependence of this solution on the manufacturing process employed for the elements depends on the force effects under operating conditions.

Accordingly, the normal force on the guidance closure element sealing surface 10, bottom closure element sealing surface 11, cylinder tube sealing surface 12 and inner tube casing sealing area 22 must be large, but the expansion in the vicinity of this sealing surface must be small, in order to reduce to a minimum the axial and radial sliding displacements of the elements sliding on each other within this sealing region.

Non-cutting forming of the elements involved in the pressure—at least, however, in the vicinity of these sealing surfaces 10; 11; 12 and 22 due to rolling-up of the thread and of the sealing chamfers against the pressure elements—has the effect that, due to the lattice displacements, the elements so formed have less extension than the neighboring normal crystalline structure of those pressure elements, which have not been subjected to non-cutting forming.

This gives the result that the total desired extension occurs within the elastic region of the materials employed, but that the stiffness characteristics assist the sealing process here disclosed.

The effect of the change of shape, which shows as a bulge in the sealing surface, can be defined in a known manner by means of the following equation $$\frac{F_p \times l_o}{E \times A} - l = e^{\varphi}$$

where the symbols have the following meaning.

$F_p$=applied force exerted on the sealing surface due to screw tightening $l_o$=total length of the elements involved in the pressure process E=Modulus of elasticity A=the pressed ring area inclined at 8 degrees (Positions 10; 11; 12; 20; 22)

ϕ=form change factor in the direction of the applied force

The micro-surface contours, which still remain in the rolling of the guide closure element sealing surface 10, of the bottom closure element sealing element surface 11, cylinder tube sealing surface 12 and inner housing sealing surface 22 can compromise the sealing performance in the event that the leakage flows occurring in these contours are subject to higher pressure than the pressures on the contacting sealing surfaces 10; 11; 12; 22.

The force acting on the guide closure element sealing surface 10, the bottom closure element sealing element surface 11, cylinder tube sealing surface 12 and inner housing sealing surface 22 as a result of screw thread tightening must therefore satisfy the following wing calculated relationship:

$$F_p \geqq [D_k + 2(s-2)^2 \times 0.785] p_B \times \upsilon$$

where the symbols have the following meanings:

$p_B$=operating pressure $D_K$=piston diameter of the operating cylinder s=wall thickness of the cylinder tube υ=safety factor The corresponding relationship, within the elastic region, can then be defined by the following equation:

$$\frac{(e+1) \times E \times A}{l_o} > [D_k + 2(s-2)^2 \times 0.785] p_B \times \upsilon$$

In order to prevent loosening of the screwed parts, all embodiments can be injected, within screw thread clearances 17 and the empty space 15 for entry of the axially entering cylinder tube 4, with low viscosity adhesive 19.

In order to ensure firm and hermetic screw-tightening, hollow space 16 is provided with adequate axial clearance for the purpose of accepting cylinder tube 4.

Non-cutting forming of the sealing surfaces satisfies the following condition:

$$R_Z \leqq 0.4\ \mu m$$

The modulus of elasticity of the materials, which are suitable for the seal-less coupling, over the temperature range from 0° to 200° C., is in the range from 60 to 250 $10^3$ $N/mm^2 \pm 10\%$ of this value.

Here the limit of loading is given by the elastic limit of the materials employed, which will be between 200 $N/mm^2$ and 1050 $N/mm^2$ for the solution here disclosed, depending on the characteristics of the material employed.

It is absolutely essential to maintain the loads within these limiting values, in order to ensure that this principle is adhered to according to the invention.

Here the following equation applies:

$$\frac{-\varepsilon \times E}{l} \leqq \upsilon_{0,2}$$

where:

−ϵ=negative extension

E=modulus of elasticity l=length of bulge

What is claimed is:

1. A fluid pressure actuator comprising a cylinder tube capable of accepting at least one piston;

a closure element provided on a first end of said cylinder tube; and a manufactured insert inserted into said closure element;

wherein respective sealing chamfers, each having a slope between 6 degrees and 12 degrees, are provided on said manufactured insert and on said first end of said cylinder tube and respective screws threads are provided on said closure element and said first end of said cylinder tube, near said respective sealing chamfers;

wherein portions of said manufactured insert and said first end of said cylinder tube including said respective sealing chamfers are made of a material having a modulus of elasticity in a range between 60*103 $N/mm^2$ and 250*103 $N/mm^2$, plus or minus 10%, and an elastic limit in a range between 200 and 1050 $N/mm^2$, over a temperature range of 0° C. to 20° C.; and whereby, when said closure element is screwed on said first end of said cylinder tube by means of said respective screw threads, said respective sealing chamfers of said manufactured insert and said first end of said cylinder tube are pressed on each other and thus interact to prevent leakage of fluid between said closure element and said first end of said cylinder tube.

2. The fluid pressure actuator of claim 1, wherein said sealing chamfer of said first end of said cylinder tube is located on an inner or outer surface of said cylinder tube.

3. The fluid pressure actuator of claim 1, wherein a groove is provided between said sealing chamfer of said cylinder tube and said screw thread of said cylinder tube.

4. The fluid pressure actuator of claim 1, wherein a free space and a hollow space are provided on respective opposite sides of said sealing chamfer of said manufactured insert.

5. The fluid pressure actuator of claim 1, wherein said sealing chamfers have a surface roughness that does not exceed 0.4 microns.

6. The fluid pressure actuator of claim 1, wherein said sealing chamfers and said screws threads are formed by a non-cutting operation.

7. A fluid pressure actuator comprising a cylinder tube capable of accepting at least one piston; and a closure element provided on a first end of said cylinder tube;

wherein respective sealing chamfers, each having a slope between 6 degrees and 12 degrees, are provided on said closure element and on said first end of said cylinder tube and respective screws threads are provided on said closure element and said first end of said cylinder tube, near said respective sealing surfaces;

wherein portions of said closure element and said first end of said cylinder tube including said respective sealing chamfers are made of a material having a modulus of elasticity in a range between 60*103 $N/mm^2$ and 250*103 $N/mm^2$, plus or minus 10%, and an elastic limit in a range between 200 and 1050 $N/mm^2$, over a temperature range of 0° C. to 20° C.; and whereby, when said closure element is screwed on said first end of said cylinder tube by means of said respective screw threads, said respective sealing chamfers of said closure element and said first end of said cylinder tube are pressed on each other and thus interact to provide sole means for preventing leakage of fluid between said closure element and said first end of said cylinder tube.

8. The fluid pressure actuator of claim 7, wherein a free space and a hollow space are provided on respective opposite sides of said sealing chamfer of said closure element.

9. The fluid pressure actuator as defined in claim 7, wherein said sealing chamfers have a surface roughness that does not exceed 0.4 microns.

* * * * *